United States Patent [19]

Connoy

[11] 4,108,556

[45] Aug. 22, 1978

[54] PRINTING PISTON ASSEMBLY

[75] Inventor: Thomas Patrick Connoy, New Brighton, Minn.

[73] Assignee: Kroy Industries, Inc., Stillwater, Minn.

[21] Appl. No.: 726,106

[22] Filed: Sep. 24, 1976

[51] Int. Cl.[2] ..... B41J 1/02; B41F 3/54

[52] U.S. Cl. ..... 400/48; 101/288; 400/654

[58] Field of Search ..... 197/2, 3, 127, 124, 197/126, 148, 138, 128; 101/287, 288, 376, 274, 269

[56] References Cited

U.S. PATENT DOCUMENTS 3,418,933 12/1968 Schaefer ..... 197/144

3,837,461 9/1974 Waibel ..... 197/126

*Primary Examiner*—Paul T. Sewell

*Attorney, Agent, or Firm*—Dorsey, Windhorst, Hannaford, Whitney & Halladay

[57] ABSTRACT

An improved force exerting means for a printing apparatus of the type having a printing station, a printing force resisting means, a front element and an image carrier wherein said improved force exerting means includes a curved force exerting surface, a means for guiding and supporting the curved surface in rolling movement relative to a printing station between first and second positions such that a printing force is exerted against successive portions of a printing surface, and means for moving the curved surface in rolling movement between said first and second positions.

19 Claims, 11 Drawing Figures

PRINTING PISTON ASSEMBLY

BACKGROUND OF THE INVENTION

The present invention relates generally to an improved printing apparatus or composing system, and more particularly, to an improved printing apparatus or composing system of the type having a printing station, a printing force resisting means, an image carrier, a font element with a raised character positionable in printing alignment with the printing station and an improved means for exerting a printing force against the raised character on the font element to transfer an image thereof to the image carrier.

The printing apparatus or composing system of the present invention has particular application in the printing of relatively large characters for use in engineering drawing title blocks, flip charts, overhead transparencies, posters, silk screen stencils, signs, newspaper headlines, etc. These characters are generally much larger than most typewriters or other conventional means can generate. In the prior art, four major methods have been used to create such letters: stencils, press-on letters, photo typesetters and dry lettering printing processes. The application of stencils and press-on letters to form words and sentences is relatively time consuming. In addition, it is easy to misalign letters and get uneven spacing. Photo typesetting systems are rather large, expensive, permanent installations having several chemical baths that must be maintained. Further, a trained operator is necessary to get good results. Although the dry lettering processes presently used overcome many of the disadvantages and limitations of stencils, press-on letters and photo typesetters, a relatively large printing force is necessary to transfer an image of the desired character from the high-carbon content toners to the image carrier. Generally, the quality of the printing or the image transfer is dependent upon the magnitude of the printing force developed.

In prior art lettering systems, a variety of printing force exerting means have been utilized. One such means involves the use of a printing piston having a flat upper surface disposed in printing relationship with a printing surface. Such printing piston is lifted by a cam element, thereby creating a printing force to transfer an image of the character on the font element to the image carrier. Such a force exerting means is shown in U.S. pending patent application Ser. No. 622,715, filed Oct. 15, 1975. A primary disadvantage of this particular means is due to the fact that the force exerting surface is flat. Because of this, the forces which must be exerted against the printing surface are quite large, thus necessarily requiring a relatively powerful motor or drive means or complicated and space consuming mechanical advantage means.

Accordingly, there is a real need for an improved force exerting means usable in a dry lettering printing process which requires a minimum amount of force to create the necessary printing force and which is yet reasonably compact and free of extensive mechanical advantage means.

SUMMARY OF THE INVENTION

In contrast to the prior art, the present invention comprises a printing apparatus or composing system involving a dry lettering process with improved means for generating the printing force. In general, the composing system of the present invention comprises a printing station, a printing force resisting means, a printing pad, an image carrier, a font element having at least one raised character positionable in printing alignment with the printing station and an improved force exerting means positioned in printing alignment with the printing station. During operation, the force exerting means exerts a printing force in the direction of the force resisting means, thus compressing the printing pad, the font element and the image carrier therebetween and causing an image of the raised character to be transferred to the image carrier.

The structure of the present invention is such that the printing force is applied against successive portions of the printing surface during the printing cycle. Because the printing force is being applied to only a portion of the printing surface at any one time, the magnitude of such force can be substantially less than if the force is applied to the entire printing surface simultaneously as in the prior art. In the preferred embodiment, the improved force exerting means comprises a generally wedge shaped rolling piston element having an upper, curved force exerting surface adapted for rolling engagement with a resilient printing pad or other force transfer means. This rolling engagement between the curved surface and the printing pad causes the printing force to be exerted against the printing surface (the surface of the raised character) and the image of such character to be transferred to the image carrier. The curved force exerting surface extends through an arc of less than approximately ninety degrees (90°) and is supported and guided in rolling movement with respect to the printing pad so that it exerts a normal force against successive portions of the printing surface.

In the preferred embodiment, the curved force exerting surface has a constant radius of curvature and the means for supporting and guiding such surface are disposed at the center of such radius of curvature. This means comprises a pair of rollers rotatable about the center of such radius of curvature and movable along a pair of parallel tracks between a first and second position. The length of the track or rail along which the rollers roll is such that a portion of the rollers will extend past the end and below the surface of the track when in their first or second position to provide a means for relieving the printing pressure at the end of a printing cycle. The improved force exerting means also includes support and guide elements to support and guide the wedge shaped element during its rolling movement and at the end of and prior to the beginning of a printing cycle when the printing pressure is relieved. This means includes a pair of guide plates with guide slots for guiding and supporting pins which extend outwardly from each side of the wedge shaped element.

The resilient printing pad which is used in combination with the improved force exerting means includes a centrally disposed resilient portion constructed of a urethane material and a section of spring steel disposed between the resilient portion of the pad and the force exerting wedge shaped element to transfer normal forces from the curved force exerting surface to the printing surface and to prevent creeping or rippling of the resilient portion of the pad during the printing process.

Accordingly, it is an object of the present invention to provide an improved printing apparatus or composing system having an improved means for exerting a printing force.

A further object of the present invention is to provide an improved printing force exerting means which is compact and which is capable of creating the relatively high pressures necessary in such a process.

Another object of the present invention is to provide an improved printing force exerting means which creates a normal printing force against successive portions of the printing surface during the printing cycle.

A further object of the present invention is to provide an improved printing pressure exerting means which comprises a generally wedge shaped roller having a curved surface of constant radius of curvature, which extends through an arc of less than 90° and which is supported and guided for rolling movement relative to a printing surface such that a normal force is exerted by said surface on successive portions of such printing surface.

A further object of the present invention is to provide an improved rolling piston in combination with a printing pad having a resilient pad portion and a thin spring steel section positioned between the rolling piston and the resilient pad portion.

These and other objects of the present invention will become apparent with reference to the drawings, the description of the preferred embodiment and the appended claims.

DESCRIPTION OF THE PREFERRED EMBODIMENT

Figure 1:
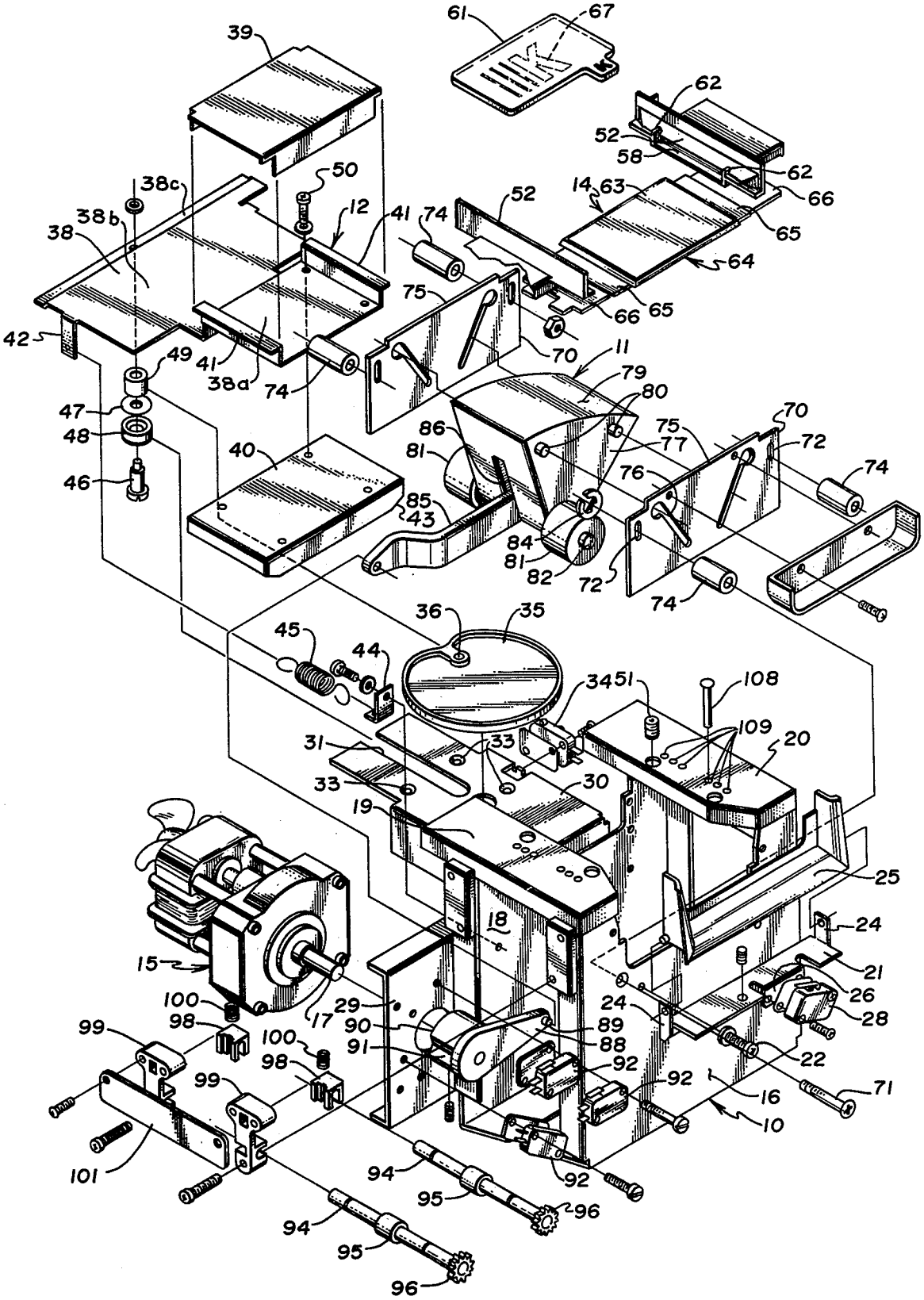
FIG. 1 is an exploded, pictorial view of the composing system of the present invention.

Reference is first made to FIG. 1 showing an expanded, pictorial view of the composing system of the present invention. In general, the system comprises a main body frame 10, a rolling piston assembly 11, a shutter assembly 12, and a printing station assembly. Also, although not specifically illustrated in the drawings, the commercial embodiment includes an apparatus cover and various other elements which do not affect the function of the apparatus, but render it more commercially acceptable and attractive. Also associated with the system are color and image carriers 59 and 60 (FIGS. 2, 3, 5 and 6) which are moved through the system in appropriate alignment with the printing station. During operation, exertion of a printing force by the piston 11 toward the shutter 12 causes an image of the raised character on a font element to be transferred to the image carrier. The force for driving the piston assmebly 11 during a printing cycle is provided by an electric motor 15.

The main body frame 10 includes front and back frame portions 16 and 18, respectively, whcih are rigidly joined together at their top surfaces by left and right hand gib assemblies, 19 and 20. The gibs 19 and 20 and the frame portions 16 and 18 are connected by welding or other appropriate means. The frame portions 16 and 18 are also connected by other brace or frame members not shown in FIG. 1. Rigidly secured to the front face of the front frame member 16 is a printing switch mounting bracket 21. The bracket 21 includes a pair of upstanding flange portions 24 with holes for rotatably supporting a print bar 25 and a downwardly disposed flange portion 26 for rigidly supporting a conventional switching element 28. The switching element 28 is activated by depressing the print bar 25. This causes rotation of the bar 25 about the flange portions 24, 24 and enables a lower portion of the bar 25 to engage and depress the switch portion of the switch 28. Activation of the switch 28 commences the printing cycle as will be described below.

Rigidly secured to the back frame member 18 by welding or other means is a motor mounting bracket 29. The electric motor 15 which drives the piston means 11 is connected with the motor mounting bracket 29 in a conventional manner by a plurality of threaded screws (not shown) which extend through the bracket 29 and into appropriate portions of the motor housing. Although various types and sizes of motors can be used, the preferred embodiment contemplates use of a 3720 UP-180 motor marketed by the Merkle Korff Gear Company. The motor 15 includes an output shaft 17 which extends through the bracket 29 for connection with a drive link 88 and a hub 90 for driving the piston assembly 11.

Figure 4:
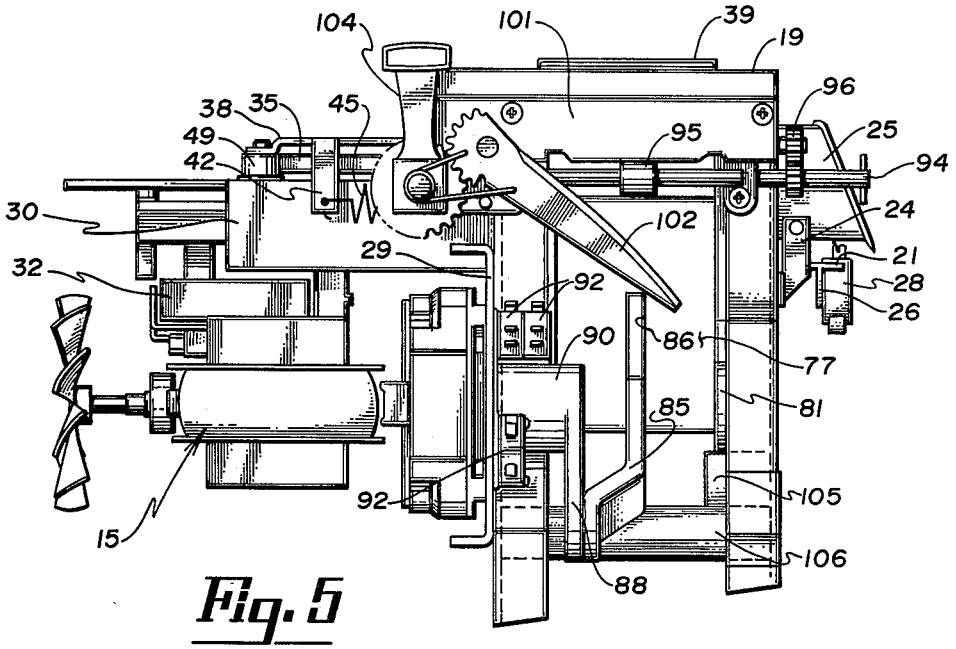
FIG. 4 is a side elevational view of the composing system of the present invention.

The shutter assembly which is identified generally in FIG. 1 by the reference numeral 12 includes a shutter assembly mounting bracket 30, a shutter assembly plate 38, a cam member 35, an anvil 40 and a shutter assembly motor 32 (FIG. 4). The shutter assembly mounting bracket 30 is rigidly secured to the back of the frame portion 18 by welding or other appropriate means and has a relatively flat upper surface and two rearwardly extending, spaced apart portions. The two spaced apart portions define an elongated guide slot 31 for guiding a portion of the shutter assembly during its movement between an operative and a non-operative position. The shutter assembly motor 32 (FIG. 4) which provides the means for moving the shutter assembly between an operative and a non-operative position is mounted to the bottom of the shutter mounting bracket 30. In the preferred embodiment, the shutter assembly motor 32 is secured to the bracket 30 by a plurality of threaded screws (not shown) extending through the holes 33. Mounted on one side of the bracket 30 is a conventional switch element 34. The switch button of the switching element 34 is engagable by a lower portion of the cam element 35 during a printing cycle to stop the shutter motor 32 and to activate the piston assembly motor 15. The cam member 35 is mounted at the point 36 for rotation with an output shaft of the shutter assembly motor 32.

The shutter assembly plate 38 includes a forward, elevated portion 38*a* having an elongated flange member 41 along each of its side edges for sliding engagement with the top, inner edges of the gib assemblies 19 and 20. The plate 38 also includes a lower, rearward section 38*b* having a pair of tabs 42 (only one of which is illustrated in FIG. 1) and an end flange section 38*c*. Connected between each of the tabs 42 and the back frame portion 18 of the composing system via a suitable bracket 44 is a coil spring member 45 which functions to continuously bias the shutter plate 38, and thus the entire shutter assembly 12, toward the forward frame portion 16. A bearing means comprising a pair of bearing members 48 and 49 is connected to the end flange section 38*c* via a threaded nut and bolt assembly 46. As illustrated, the bearing member 48 is a generally circular member having a grooved periphery adapted for movement along the slot 31 of the bracket 30. Such movement guides the rearward portion of the plate 38 during movement of the shutter assembly between an operative and a nonoperative position. The bearing member 49 which is separated from the member 48 by a washer 47 is adapted for engagement with the peripheral cam surface of the cam element 35. During rotation of the output shaft of the shutter assembly motor 32, and thus rotation of the cam member 35, engagement between the eccentric peripheral cam surface of the member 35 and the bearing member 49 causes the shutter plate 38 to move between an operative position in which the forward portion of the plate 38*a* is directly above the piston assembly 11 and a nonoperative position in which the forward portion of the plate 38*a* is positioned to the rear of the piston assembly.

Figure 2:
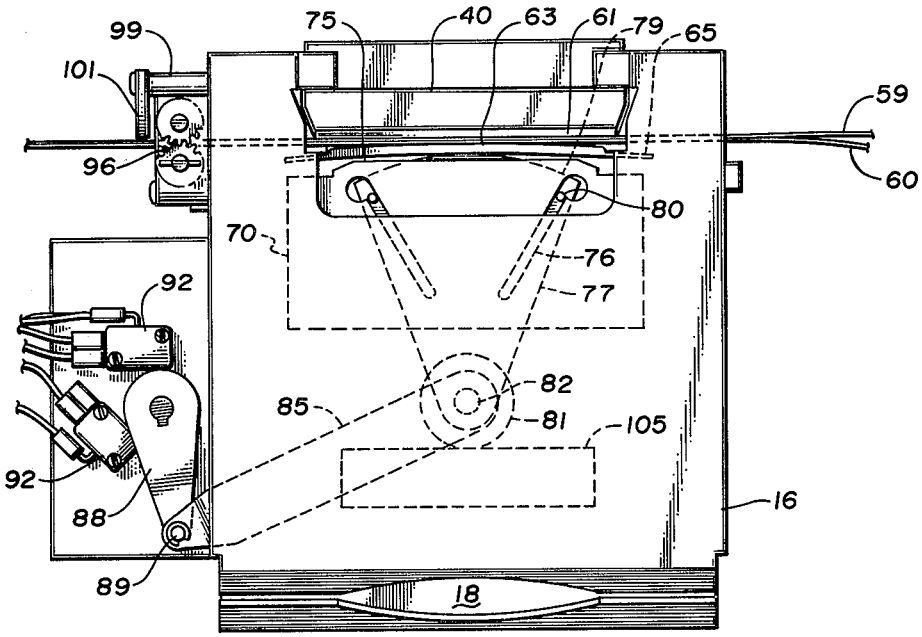
FIG. 2 is an elevational view of the front of the composing system of the present invention showing the improved force exerting means in the middle of a printing cycle.
Figure 3:
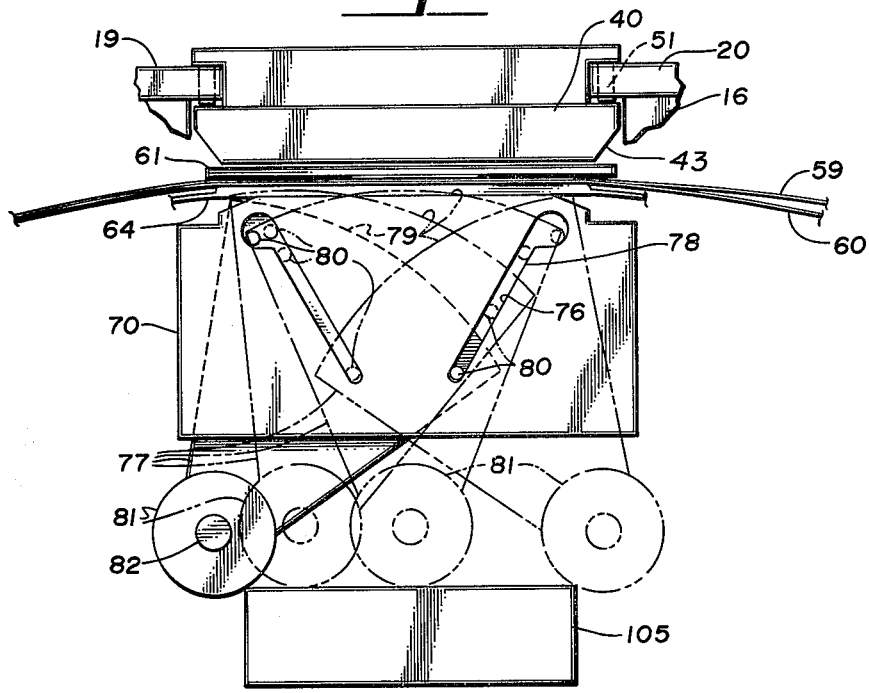
FIG. 3 is a front elevational view showing the printing station and various positions of the force exerting means during its travel through a printing cycle.
Figure 5:
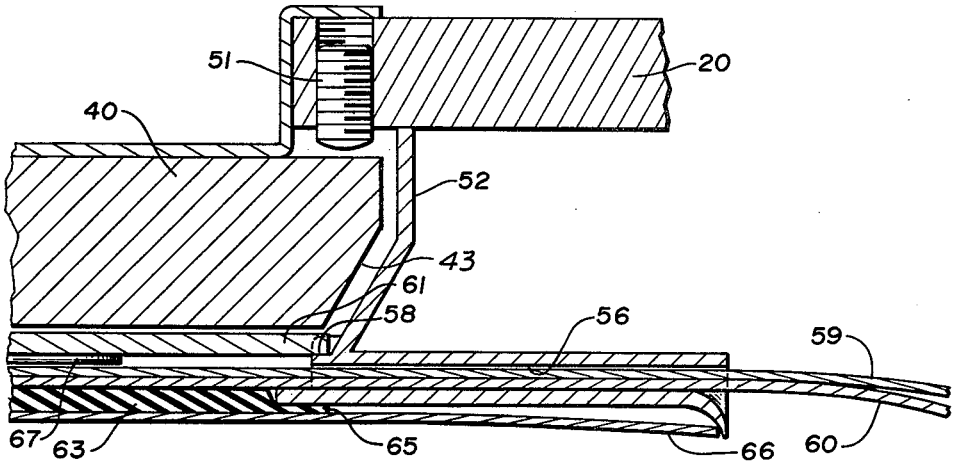
FIG. 5 is an enlarged view of a portion of the printing station showing the relationship between the font element, the force resisting means, the resilient printing pad and the color and image carriers.

An anvil member 40 is rigidly secured to the bottom surface of the forward portion of the plate 38*a* by a plurality of screws 50. The anvil 40 functions as a backing member for the printing force to resist the force exerted by the piston assembly during a printing cycle. Such resistance allows for the generation of the necessary printing pressure between the piston assembly 11 and the anvil 40. As illustrated best in FIGS. 2, 3, 5 and 6 the anvil 40 is a solid, relatively rectangular member having beveled edges 43 along each of its outer lower portions such that the elongated beveled surfaces oppose each other and extend generally parallel to the direction of movement of the shutter assembly. As shown in FIGS. 2, 3 and 5, a portion of the anvil 40 extends outwardly past the inner edge of each of the gib assemblies 19 and 20. With this construction, upward movement against the lower surface of the anvil 40 is resisted as the result of engagement between the anvil 40 and the gib assemblies 19 and 20. A cover 39 is secured to the forward plate portion 38*a* by an adhesive.

As shown best in FIGS. 3 and 5, the tolerance between the lower surface of the gib assemblies 19 and 20 and the upper surface of the anvil 40 is sufficient to permit a plurality of adjusting members 51 to extend for a limited distance below the lower surface of the gib assemblies 19 and 20. During a printing cycle, the function of the anvil 40 is to resist the printing force exerted by the piston assembly 11. Such resistance causes compression of the resilient printing pad 64 and generation of the printing force. In general, the greater the resistance, the greater the printing force. In the present apparatus, resistance by anvil 40 can be increased by limiting its upward movement. This is accomplished by adjustment of the members 51. The printing force adjustment members 51 comprise a plurality of threaded members extending through threaded openings in the gib assemblies 19 and 20. Such members 51 are threadedly adjustable to various positions in which the lower surfaces thereof extend below the lower surfaces of the gib assemblies 19 and 20. If the members 51 are retracted such that they do not extend below the lower surfaces of the gibs 19 and 20, the upward movement of the anvil 40 is limited by the lower surface of the gibs.

The printing station is positioned between the front and back frame members 16 and 18 and generally between the anvil 40, when it is in its operative position, and the piston assembly 11. Positioned on each end of the printing station is a tape guide element 52 which supports and guides the color and image carriers and provides means for properly aligning the font element 61. As illustrated best in FIGS. 1 and 5, the tape guide elements or chutes 52 are appropriately mounted below the gib assemblies 19 and 20 and between the front and back frame portions 16 and 18. Each of the guide members 52 comprises a generally elongated guide slot 56 extending generally horizontally away from the printing station to guide a color carrier or toner 59 and an image carrier 60 through the composing system and past the printing station. Each of the guide members 56 also includes a font element nest or shoulder portion 58 and a pair of end tabs 62 for supporting the font element 61 in printing alignment during the printing cycle.

Figure 9:
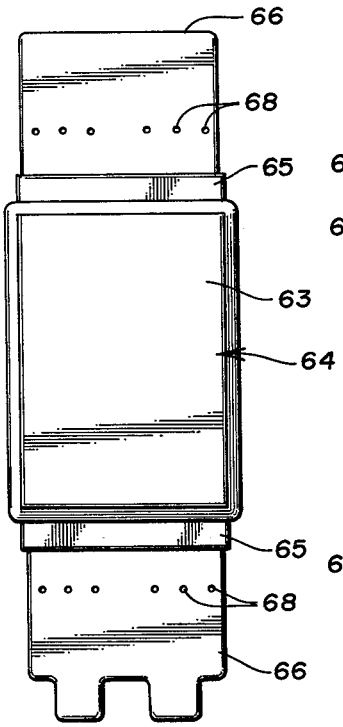
FIGS. 9, 10 and 11 are top, side and end elevational views of the improved printing pad.
Figure 10:
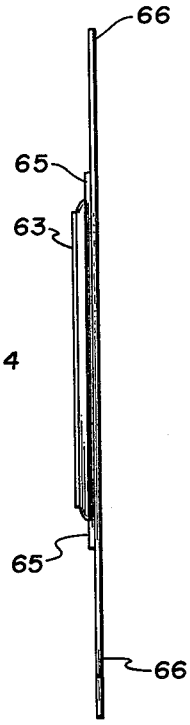
Figure 11:
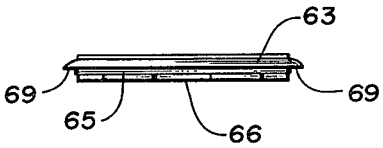

Positioned between the tape guide elements 52 and immediately above the printing piston assembly 11 is an elongated printing pad 64. As shown best in FIGS. 9, 10 and 11, the printing pad 64 comprises a generally rectangular, centrally located resilient printing pad portion 63, a pair of elongated end tab section 65 which extend outwardly from the two ends of the central printing pad portion 63 and a thin, generally rectangular piece of spring steel extending over the entire bottom surface of the central portion 63 and the tabs 65 and a limited distance past the ends of the tabs 65. The tabs 65 are integrally joined with the central portion 63 and the spring steel portion 66 is connected with the bottom surface of the tab portions 65 by an appropriate adhesive. In the preferred structure there is no connection between the bottom of the central portion 63 and the spring steel section 66. The purpose of the spring steel is to prevent the central portion of the printing pad 63 from creeping or rippling during rolling movement of the piston assembly 11 against the underside of the printing pad. In the preferred embodiment, the member 66 is constructed from a full heat treated clock spring steel. The centrally located rectangular portion 63 and the tabs 65 are constructed of a resilient, elastomeric material which in the preferred embodiment is a urethane material having approximately a 68 Shore D hardness. A plurality of hole 68 are present in the steel strip portion 66 for alignment with the guide pin locating holes 109 (FIG. 1) in the gib assemblies 19 and 20.

Figure 7:
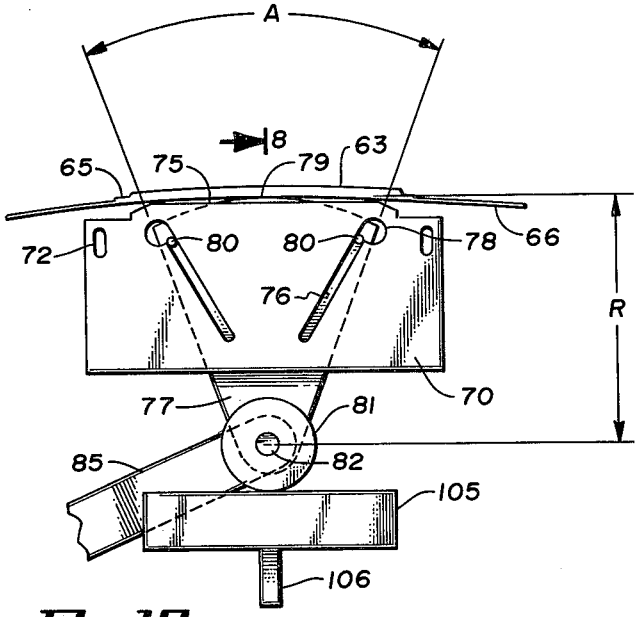
FIG. 7 is an enlarged plan view of the force exerting means as viewed from the inner surface of the front portion of the composing system frame.
Figure 8:
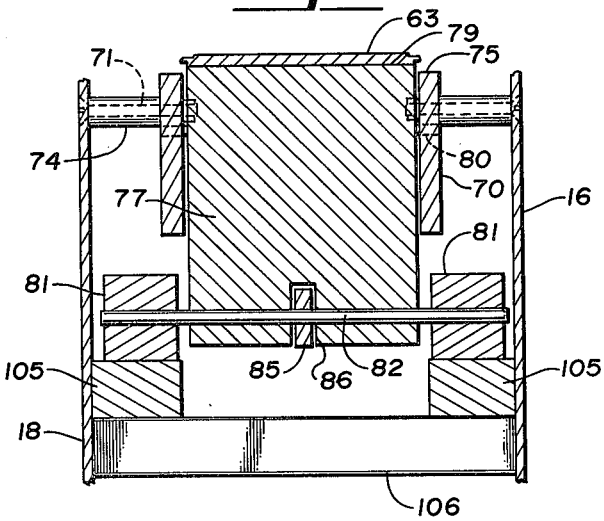
FIG. 8 is a sectional view of the rolling piston as viewed along the line 8—8 of FIG. 7.

The central portion 63 of the pad 64 includes a pair of overhanging edges 69, 69 which extend outwardly from the sides of the tab portions 65 and the steel strip 66. These edge portions 69 are adapted to rest on and be supported by the top edges 75 of a pair of support and guide plates 70, 70 (FIGS. 1, 7 and 8).

When supported in this position, a portion of the tabs 65 and the portions of the spring steel section 66 which extend outwardly from the tabs 65 are disposed beneath the elongated guide portions 56 of the elements 52. Positioning of the tabs 65 and steel sections 66 beneath the elements 52 in this manner helps to retain the printing pad 64 in its properly aligned position.

One of the support and guide plates 70 is rigidly mounted to the inside surface of each of the front and back frame portions 16 and 18 by a plurality of screws 71 which extend through the openings 72 in the plates 70 and through a corresponding opening in the respective frame portions 16 and 18. A cylindrical spacing member 74 is positioned between the respective frame portions 16 and 18 and the plates 70 to properly align and space the plates 70 relative to each other.

The font element 61 which is illustrated in FIG. 1 is a generally rectangular, injection molded plastic element adapted to rest on the supporting shoulder 58 of the elements 52 and to be retained in proper alignment by the shoulders 58 and the tabs 62. Disposed on the bottom surface of the font element 61 is a raised character 67, an image of which is transferred to the image carrier during a printing cycle. The forward edge of the font element 61 includes a tab portion for ease in handling and identification. When the font element 61 is in proper printing alignment as illustration in FIGS. 5 and 6, the bottom surface of the raised character 67 constitutes the printing surface against which the printing force is exerted to transfer an image of the raised character to the image carrier. During operation of the system, a color carrier 59 having a high pigment content and an image carrying tape 60 having a color receptive finish are disposed between element 61 and the central portion of the printing pad 63. When the font element 61 and the central printing portion 63 are compressed together, via the printing force, an image of the raised character 67 is transferred from the color carrier 59 to the image carrier 60.

With general reference again to FIG. 1 and more specific reference to FIGS. 2, 3 and 6–8, the printing piston assembly 11 can be seen including an upper curved force exerting surface 79 and a means connected with said force exerting surface 79 for supporting and guiding such surface in rolling movement with respect to the printing station such that a normal or perpendicular printing force is exerted against successive portions of the printing surface. Specifically, the piston assembly of the preferred embodiment comprises a generally wedge or pie shaped section 77 having a curved, upper force exerting surface 79 of a constant radius of curvature R (FIG. 7). A shaft 82 extends through the lower end of the wedge shaped element at the center of the radius of curvature R and rotatably supports a roller 81 on each side of the body portion 77. The rollers 81 are retained on the shaft 82 by a pair of lock rings 84 (FIG. 1) and are adapted for rolling movement along a pair of appropriately spaced, relatively horizontal, parallel rails or tracks 105. The tracks 105 are welded or otherwise rigidly secured to the inside surfaces of the frame portions 16 and 18 as illustrated in FIG. 8 and are additionally supported by the brace member 106 extending between the frame members 16 and 18 and below the rails 105.

Figure 6:
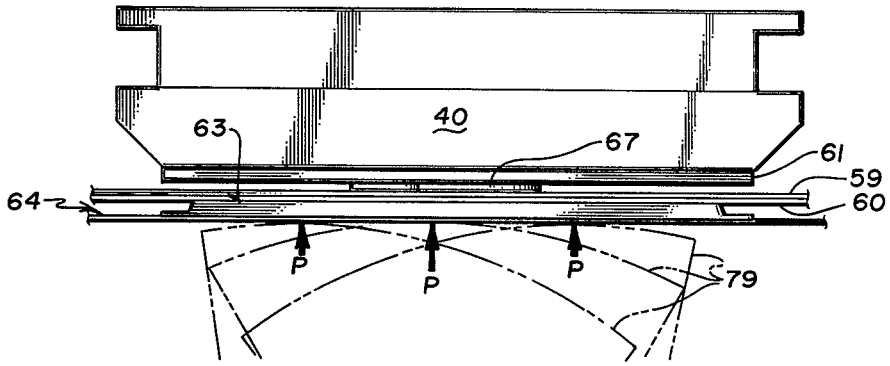
FIG. 6 is a further view of the printing station showing the curved surface of the rolling piston in various positions.

With particular reference to FIG. 7, it can be seen that the curved surface 79 extends through an arc "A" of approximately 45°. Although the advantages of the present invention can be achieved with arcs "A" of various sizes, they are best achieved when such arc "A" is less than 90°. One of the principal advantages of the present piston assembly is that it allows for the creation of substantial printing pressures with a minimum exertion of force from the driving means. This results from the utilization of the curved surface 79 as the force exerting means and the fact that the printing pressure is applied to successive portions of the printing surface during the printing cycle. This is best illustrated in FIG. 6 which shows the printing force P being applied at right angles to or against successive portions of the printing surface (the raised character 67) during rolling movement of the piston through a printing cycle. Because of the large printing pressures which must be developed, the radius of curvature R (FIG. 7) of the curved surface 79 must be sufficiently large to prevent the printing pad 64 from scooting or creeping during rolling movement of the surface 79 against the bottom of the pad 64. Because of the relatively large radius of curvature R which is required, extension of the curved surface 79 through an arc "A" greater than 90° would result in an undesirably large, bulky structure.

Each of the tracks 105 includes a relatively flat surface portion for engagement with the rollers 81 during the force exerting portion of the printing cycle. At each end of the printing cycle, however, the rollers 81 are allowed to roll partially past this flat surface so that when the rollers 81 and the curved surface 79 are in their respective end positions as shown in FIG. 3, a portion of the rollers extends past the end of and below the flat or guiding surface of the tracks 105. This results in release of the printing force to allow the shutter assembly to be retracted to its nonoperative position and the font element to be changed. In the preferred embodiment, the tracks 105 are disposed generally horizontally and generally parallel to the printing surface which is comprised of the lower surface of the raised character 67 when the font element 61 is in printing alignment. Such a construction results in a constant normal printing force being exerted against successive portions of the printing surface during the rolling movement of the piston assembly 11 between its end positions.

Integrally connected with each of the front and back faces of the wedge shaped piston element 77 are a pair of guide pins 80 extending a limited distance outwardly from such faces. As shown best in FIGS. 1–3, 7 and 8, the guide pins 80 are adapted to ride in and be guided by the generally elongated guide slots 76 in the guide plates 70. Each of the guide slots 76 comprises a generally elongated opening having an enlarged portion near its top to accommodate movement of the pins when the printing force is released. The actual shape and position of the slots 76 conforms substantially to the path of movement of the guide pins 80 between their respective end positions during a printing cycle. FIG. 3 shows the rolling piston in a variety of positions during the printing cycle and shows the corresponding positions of the guide pins 80. Although the guide pins 80 and corresponding guide slots 76 help in properly guiding the piston 11 during a printing cycle, their principal function is to help guide and support the piston 11 at the completion of each printing cycle when the printing force is released. If the guide pins 80 and slots 76 or some other support elements were not present, the piston assembly 11 would pivot about the shaft 82 and would not maintain its alignment for the next printing cycle.

The force which drives the piston assembly 11 is provided by the electric motor 15 (FIG. 1) through the hub 90, the drive link 88 and the motion transmitting link 85. The electric motor 15 includes an output shaft 17 which is securely connected with the drive motor hub 90 by appropriate means such as a setscrew. The hub 90 is brazed or welded to the drive link 88 which includes an eccentric drive pin 89 adapted for connection with one end of the motion transmitting link 85. As best illustrated in FIGS. 1, 2, 7 and 8, the motion transmitting link 85 has one end rotatably secured to the shaft member 82 and the other end secured to the motion transmitting pin 89. As the pin 89 is caused to rotate about the output shaft 17, corresponding translational movement is imparted to the rolling piston assembly 11 via the link 85. As will be discussed below, the drive link 88 and drive pin 89 move through an arc of about 180° during each printing cycle. This movement causes corresponding translational movement of the piston 11 and the rollers 82 from one end of the rails 105 to the other.

As shown best in FIG. 1, the peripheral surface of the hub 90 includes a pair of groove portions 91 adapted for appropriate association with a plurality of switching members 92 and appropriately secured to the motor mounting bracket 29. During rotation of the hub 90, the peripheral surface functions to depress the switching elements on each of the three switches 92, except when such switching element is aligned with one of the two groove portions 91. When this occurs, the switching element is released. Through appropriate positioning of the grooves 91 and the switches 92, the starting and stopping of the motor 51 and the interaction of such motor with the shutter assembly motor 32 is controlled.

Associated with an edge of each of the frame portions 16 and 18 is a tape and ribbon advance means which comprises a pair of elongated shaft members 94 with center rubber portions 95. The shaft members 94 are rotatably supported by appropriate bearing elements 99 and 98 and mounted with respect to the frame members 16 and 18 by a mounting plate or shear blade 101 and a plurality of screws such that center rubber portions 95 are engaged with each other. A pair of springs 100 are disposed between a portion of the bearings 99 and the bearings 98 to bias the two shafts 94 toward each other. Each of the shafts 94 includes a cooperating gear member 96 at its outer end to permit simultaneous rotational movement of the shafts 94. When appropriately mounted to the frame members 16 and 18, such elements serve as a means for advancing the color and image carriers 59 and 60 through the machine.

Associated with the plate 101 is a shear or scissors element 102 designed for shearing engagement with the plate 101. In the preferred embodiment, as illustrated in FIG. 4, shearing rotation of the element 102 is caused by appropriate pivotal movement of the element 104. The shearing mechanism functions to cut-off or shear a printed portion of the image and color carriers for removal from the machine.

Having now described the structure of the composing system of the present invention, the operation can be described as follows:

First, prior to the initiation of any printing cycle, the rolling piston 11 is positioned in one of the two end positions illustrated in FIG. 3 with the rollers 81 partially past the edge of the rails 105. In this position the printing force is released. The printing pad 64 is appropriately positioned in the machine with the outer edges 69 (FIG. 11) being supported by the upper surfaces 75 of the guide elements 70 (FIG. 1). Also, prior to the initiation of any printing cycle, the image carrier 59 and the color carrier 60 are threaded through the machine as shown in FIGS. 2, 3, 5 and 6 such that they are disposed above the printing pad 64. To properly align the image and color carriers 59 and 60 during their movement through the machine, a plurality of holes 109 are positioned in the gibs 19 and 20 and adapted to receive guide pins 108. In the actual embodiment, a guide pin 108 is associated with each of the four sets of guide holes 109 to define the path of the color and image carriers 59 and 60 and to guide the same through the machine. Prior to initiation of a printing cycle, the shutter assembly 12 (FIG. 1) is in its nonoperative rearward position in which the anvil 40 is positioned rearwardly of the printing station.

In operating the system, the operator first selects the desired character to be printed and positions the appropriate font element 61 in proper printing alignment with its edges supported by the surfaces 58 and its corners being aligned by the tabs 62 (FIG. 1). The printing cycle is then commenced by depressing the print bar 25 to activate the switch element 28. This starts the shutter assembly motor 32 (FIG. 4) causing rotation of the cam element 35 and movement of the entire shutter assembly including the anvil 40 to an operative position. When in an operative position, the anvil 40 is positioned directly above the printing pad 64 and the aligned font element 61. When this position is reached, a switch element (not shown) mounted to a portion of the system cover is engaged by the cam element 35, thereby stopping the shutter motor 32 and starting the piston assembly drive motor 15.

Operation of the piston assembly motor 15 causes rotation of the drive link 88 and corresponding translational movement of the shaft 82 and thus the rollers 81 between a first and second position from one end of the track 105 to the other. Such movement of the shaft 82 and rollers 81 causes the upper curved force exerting surface 79 of the piston 11 to advance in rolling movement between a first and second position along the lower surface of the printing pad 64. During such movement, as best illustrated in FIGS. 3 and 6, the printing pad 64, the font element 61 and the color and image carriers 59 and 60 are compressed at successive points between the anvil 40 and the force exerting surface 79. This compression results in the generation of a printing force against successive portions of the raised character on the font element and causes an image of such character to be transferred to the image carrier 60. As the piston assembly completes its rolling movement, the rollers 81 fall slightly off the end of the tracks 105 to release the printing pressure. At this point, the relationship between the grooves 91 and the switching elements 92 is such that the piston assembly motor 15 is stopped and the shutter assembly motor 32 is started to move the shutter assembly and thus the anvil 40 to its nonoperative position. When the shutter assembly reaches its nonoperative position, a tab portion on the underside of the cam element 35 engages a switching element on the switch 34 to turn off the shutter assembly motor 32. The font element 61 can then be removed and replaced by the next desired character and the color and image carriers 59 and 60 can be advanced by appropriate rotation of the shafts 94.

Although the description of the preferred embodiment has been quite specific, it is contemplated that various modifications could be made to such embodiment without deviating from the spirit of the present invention. For example, it is contemplated that a variety of means can be used to help guide and support the piston element 11 both during the printing cycle and at the end of the printing cycle when the printing force is released. Also, as discussed above, the present invention shows the piston 11 being guided in rolling movement by a pair of rollers 81 rotatably mounted to a shaft 82 positioned at the center of the radius of curvature of the curved surface. It is contemplated that the piston can be supported and guided at virtually any point provided the rolling movement of the piston against the underside of the printing pad simulates rolling rotation about the center of the radius of curvature. Also, the preferred embodiment shows a particular orientation and arrangement of the printing pad 64, font element 61 and color and image carriers 59 and 60. It is contemplated that the arrangement of these elements can be changed without deviating from the principal feature of the present invention which is to provide an improved means for exerting a printing force. Accordingly, it is intended that the scope of the present invention be dictated by the appended claims rather than by the description of the preferred embodiment.

I claim:

1. In a printing apparatus of the type having a printing station, a force resisting means for resisting a printing force, a force exerting means positioned in printing alignment with said printing station for exerting a printing force toward said force resisting means, and an image carrier and a font element with at least one raised character, each being disposed between said force resisting means and said force exerting means and each being positionable in printing alignment with said printing station wherein said force exerting means comprises:

a generally wedge shaped element having a curved force exerting surface extending through an arc of less than approximately ninety degrees;

support and guide means for supporting and guiding said force exerting surface in rolling movement with respect to said printing station between first and second positions such that a normal printing force is exerted against successive portions of said raised character during said rolling movement to transfer an image of said raised character to said image carrier; and means for moving said force exerting surface in rolling movement between said first and second positions.

2. The printing apparatus of claim 1 wherein said curved force exerting surface has a constant radius of curvature.

3. The printing apparatus of claim 2 wherein said support and guide means includes a first support and guide means comprising a support and guide surface for supporting and guiding a first point on said wedge shaped element in translational movement between first and second positions corresponding respectively to said first and second positions of said force exerting surface.

4. The printing apparatus of claim 3 wherein said first support and guide means includes a track means positioned on each side of said wedge shaped element and a roller means rotatably mounted to said wedge shaped portion on each side thereof at said first point for rolling engagement with said track means.

5. The printing apparatus of claim 4 wherein said first point is the center of the radius of curvature of said curved force exerting surface.

6. The printing apparatus of claim 5 wherein each of said track means has a generally flat portion of a length such that a portion of said roller means extends past an end of and below the surface of said flat portion when said first point is in its first and second positions.

7. The printing apparatus of claim 1 wherein said curved surface extends through an arc of approximately 45°.

8. The printing apparatus of claim 1 having a resilient printing pad element disposed between said curved force exerting surface and said force resisting means.

9. The printing apparatus of claim 8 wherein said printing pad element includes a resilient material portion composed of an elastomeric material.

10. The printing apparatus of claim 9 wherein said printing pad element includes a spring steel portion secured to portions of said resilient material portion and disposed between said resilient material portion and said curved force exerting surface.

11. The printing apparatus of claim 10 wherein said spring steel portion is a flat, generally rectangular element adapted for engagement with said force exerting surface during rolling movement of said surface between said first and second positions.

12. The printing apparatus of claim 11 wherein said resilient material portion and said spring steel portion are secured to each other by an adhesive.

13. In a printing apparatus of the type having a printing station, a force resisiting means for resisting a printing force, a force exerting means positioned in printing alignment with said printing station for exerting a printing force toward said force resisting means, and an image carrier and a font element with at least one raised character, each being disposed between said force resisting means and said force exerting means and each being positionable in printing alignment with said printing station wherein said force exerting means comprises:

a generally wedge shaped element with a curved force exerting surface of a constant radius of curvature extending through an arc of less than approximately ninety degrees;

support and guide means for supporting and guiding said force exerting surface in rolling movement with respect to said printing station between first and second positions such that a normal printing force is exerted against successive portions of said raised character to transfer an image of said raised character to said image carrier, said support and guide means including a first support and guide means comprising a support and guide surface for supporting and guiding a first point on said wedge shaped element in translational movement between first and second positions corresponding respectively to said first and second positions of said force exerting surface, said first support and guide means further including a track means positioned on each side of said wedge shaped element and a roller means rotatably mounted to said wedge shaped portion on each side thereof at the center of the radius of curvature of said curved force exerting surface for rolling engagement with said track means, said track means having a generally flat portion of a length such that a portion of said roller means extends past an end of and below the surface of said flat portion when said first point is in its first and second positions;

said support and guide means further including a second support and guide means for supporting and guiding a second point on said wedge shaped element in translational movement between first and second positions corresponding respectively to said first and second positions of said force exerting surface; and means for moving said force exerting surface in rolling movement between first and second positions.

14. The printing apparatus of claim 8 wherein said second support and guide means includes a support and guide plate positioned on at least one side of said wedge shaped element.

15. The printing apparatus of claim 14 wherein said support and guide plate includes a guide slot and said wedge shaped portion includes a pin member at said second point adapted for translational movement within said guide slot between said first and second positions.

16. The printing apparatus of claim 15 wherein said guide slot is generally elongated and includes an enlarged end portion.

17. The printing apparatus of claim 15 wherein said support and guide plate includes a pair of guide slots for guiding second and third points on said wedge shaped element between their respective first and second positions corresponding respectively to said first and second positions of said force exerting surface.

18. The printing apparatus of claim 13 wherein said wedge portion includes pin members at each of said second and third points adapted for translational movement within said pair of guide slots between said first and second positions.

19. The printing apparatus of claim 18 wherein said second support and guide means includes a support and guide plate on each side of said wedge shaped element, wherein each of said support and guide plates includes a pair of guide slots, and wherein each side of said wedge shaped portion includes pin members at second and third pints adapted for translational movement within said pair of guide slots between first and second positions.

* * * * *